US009993381B2

(12) United States Patent
Blackwell et al.

(10) Patent No.: US 9,993,381 B2
(45) Date of Patent: Jun. 12, 2018

(54) KNEE POSITIONER WITH EXPANDABLE CARRIAGE

(71) Applicant: Innovative Medical Products, Inc., Plainville, CT (US)

(72) Inventors: Tim Blackwell, Jupiter, FL (US); Tamas Kovacs, Bristol, CT (US)

(73) Assignee: INNOVATIVE MEDICAL PRODUCTS, INC., Plainville, CT (US)

( * ) Notice: Subject to any disclaimer, the term of this patent is extended or adjusted under 35 U.S.C. 154(b) by 171 days.

(21) Appl. No.: 14/726,455

(22) Filed: May 29, 2015

(65) Prior Publication Data

US 2016/0346151 A1 Dec. 1, 2016

(51) Int. Cl.
*A61G 13/00* (2006.01)
*A61G 13/12* (2006.01)
*A61G 13/10* (2006.01)

(52) U.S. Cl.
CPC ..... *A61G 13/101* (2013.01); *A61G 13/125* (2013.01); *A61G 13/1245* (2013.01); *A61G 13/0063* (2016.11)

(58) Field of Classification Search
CPC ..... A61G 13/1245; A61G 13/101; A61G 13/124; A61G 13/125; A61G 13/1235; A61G 2203/78; A61B 17/0206; A61B 2017/0268
See application file for complete search history.

(56) References Cited

U.S. PATENT DOCUMENTS 6,234,173 B1 * 5/2001 Hajianpour ..... A61G 13/0063 128/869
2012/0124748 A1 * 5/2012 Soto ..... A61G 13/101 5/640
2013/0019883 A1 * 1/2013 Worm ..... A61G 13/101 128/882
2015/0250672 A1 * 9/2015 Fossez ..... A61G 13/1245 5/630
2016/0281920 A1 * 9/2016 Perez ..... F16M 13/022
2016/0296401 A1 * 10/2016 Cole ..... A61F 5/3776
2016/0361219 A1 * 12/2016 Herrig ..... A61G 13/101

FOREIGN PATENT DOCUMENTS

GB 743130 A * 1/1956 ..... A61G 13/10
WO WO 2007074532 A1 * 7/2007 ..... A61G 13/101
WO WO 2016071092 A1 * 5/2016 ..... A61G 13/101

* cited by examiner

*Primary Examiner* — Kim M Lewis
(74) *Attorney, Agent, or Firm* — Damian Wasserbauer, Esq.; Wasserbauer Law LLC

(57) ABSTRACT

Apparatus for adjustably positioning extremity or body part such as knees hands, or feet for a surgical procedure having a carriage with a base adapted to engage a track for sliding movement there along, an arm configured to fit to the base at a hinge secured by a pin, a socket formed by the joining of the base and arm configured to accept a ball of a holder generally adapted to engage and support the extremity upon which the surgical procedure is to be performed, and a clamp adjacent cooperating with the hinge to lock a position of the carriage along a track and to lock a holder of an extremity in a secure position. The carriage is configured to be tightened and loosened by the movement of one handle, thereby forming a releasable lock to the ball in the socket and carriage position.

11 Claims, 7 Drawing Sheets

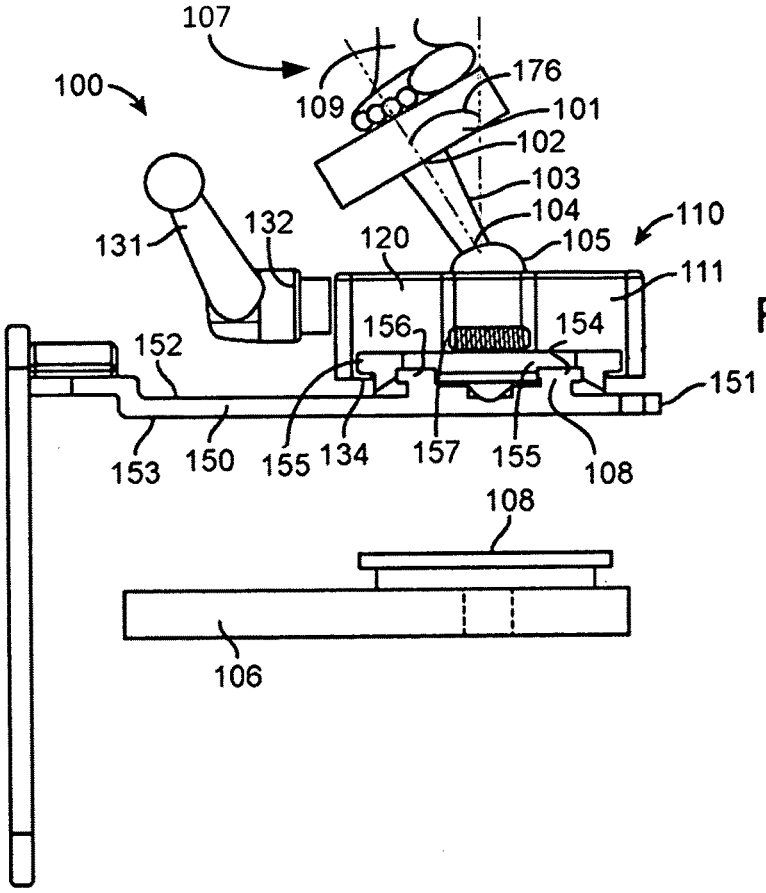
FIG. 9A
FIG. 9C
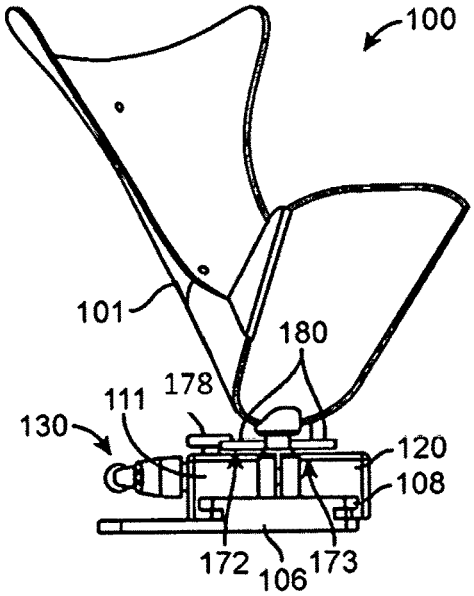
FIG. 9B

KNEE POSITIONER WITH EXPANDABLE CARRIAGE

FIELD OF THE INVENTION

This invention relates to apparatus of the type used for the positive positioning of a body part such as, for example, hands, feet, knees, etc., for surgical procedures and other medical activities where the body part must be maintained in the selected optimum position and, more particularly, to an apparatus with tilt control and adjustable by one hand operation having improved holding strength, sterilization function.

BACKGROUND OF THE INVENTION

Surgical procedures increasingly require that the joint, limb or body part to be operated upon to be precisely and predictably positioned during such surgery. Optimum positioning requires a large range of positive positioning adjustments to be easily available so that the limb or joint to be treated is initially positioned and thereafter maintained in the desired position. Not only must such selected position be maintainable but also it is very important and often necessary that the limb be released and repositioned on demand during the course of the procedure to ensure optimum access thereby to require a variety of angular relationships for effective surgery.

Medical devices, including surgical equipment for holding a body part, that have contact with body tissues or fluids are considered critical items as these items should be sterile when used because any microbial contamination could result in disease transmission. If these items are heat resistant, the recommended sterilization process is steam sterilization, because it has the largest margin of safety due to its reliability, consistency, and lethality. Most medical and surgical devices used in healthcare facilities are made of materials that are heat stable and therefore undergo heat, primarily steam, sterilization. Sterilization destroys all microorganisms on the surface of an article or in a fluid to prevent disease transmission associated with the use of that item. Sterilization refers to any process that eliminates, removes and/or kills all forms of life, including transmissible agents such as fungi, bacteria, viruses, spore forms, etc. present on a surface, which can be achieved by applying heat, chemicals, irradiation, high pressure, and filtration or combinations thereof. The concept of what constitutes "sterile" is measured as a probability of sterility for each item to be sterilized. This probability is commonly referred to as the sterility assurance level (SAL).

Sterilization facilities are separate from operating rooms to perform heat sterilization on surgical equipment in an autoclave, sometimes called a converter. If sterilization is needed in the operating room, flash sterilization methods are used, for example, should the plate become unsterile for any reason then flash sterilization methods require placing in hot liquids to remove pathogens and afterwards instruments may take longer to reach the required room-temperature after sterilization while cooling thereby delaying the surgical procedure and adding cost.

Problems in sterilizing surgical equipment for holding a body part abound Disadvantages of previous surgical equipment for holding a body part include the costs associated with sterilization, whereby nooks and folds where residues accumulate and cannot be, or require increased effort to be, dislodged. Another design problem is in use of multiple parts, whereby the entire set of complex rails, tubes and other parts of the surgical equipment and apparatus required disassembly, scrubbing, power washing and other procedures that increased the cost of the sterilization and overall procedure. In addition, parts of the surgical equipment for holding a body part could get lost or removal may void warranties. In general, such surgical equipment for holding a body part during a surgical procedure required sterilization before entering an operating room. Once the surgical procedure ends, the surgical equipment again requires sterilization.

These problems involving the sterilization of surgical equipment have existed for a long period of time without solution. The problem also involves design and construction involving multiple parts such as, for example, complex rails, tubes and other apparatus secured to an operating table. As a result, a simplified design for surgical equipment for holding a body part is desired that reduces these and other disadvantages including the cost of the sterilization and overall time and cost of the procedure.

SUMMARY OF THE INVENTION

It is an object of the apparatus, system and method of the present invention to provide a carriage for positioning an extremity holder featuring two locking points achieved by one locking mechanism that is an improvement to prior designs in functionality and holding strength.

It is an object of the apparatus, system and method of the present invention to provide a extremity holder such as for a positioning a knee for surgery utilizing a locking the ball and carriage on the fly with a one arm lock and ergonomic handle.

It is an object of the apparatus, system and method of the present invention to provide a carriage having advantages of minimum parts so as to improve use, sterilization, maintenance thereof.

It is an object of the present invention to provide an apparatus, system and method of treatment that advantageously is rugged in structure and provides support for the patient's limbs or body during the preparation for surgery, when it is necessary to have an extremity draped and available for operation.

It is an object of the apparatus, system and method of the present invention to provide a carriage with tilt control for use in surgical procedures of a larger limb (i.e. heavier), the weight of the body part.

It is an object to provide a carriage with tilt control with minimum parts so as to improve use, sterilization, maintenance thereof.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein:

FIG. 9A illustrates a side view of the carriage on a track according to an embodiment of the present invention; FIG. 9B illustrates a perspective side view of the carriage with tilt control on both sides of the extremity holder according to another embodiment of the present invention; and FIG. 9C is an end view of the base plate and track;

DESCRIPTION OF THE EMBODIMENTS

Figure 1:
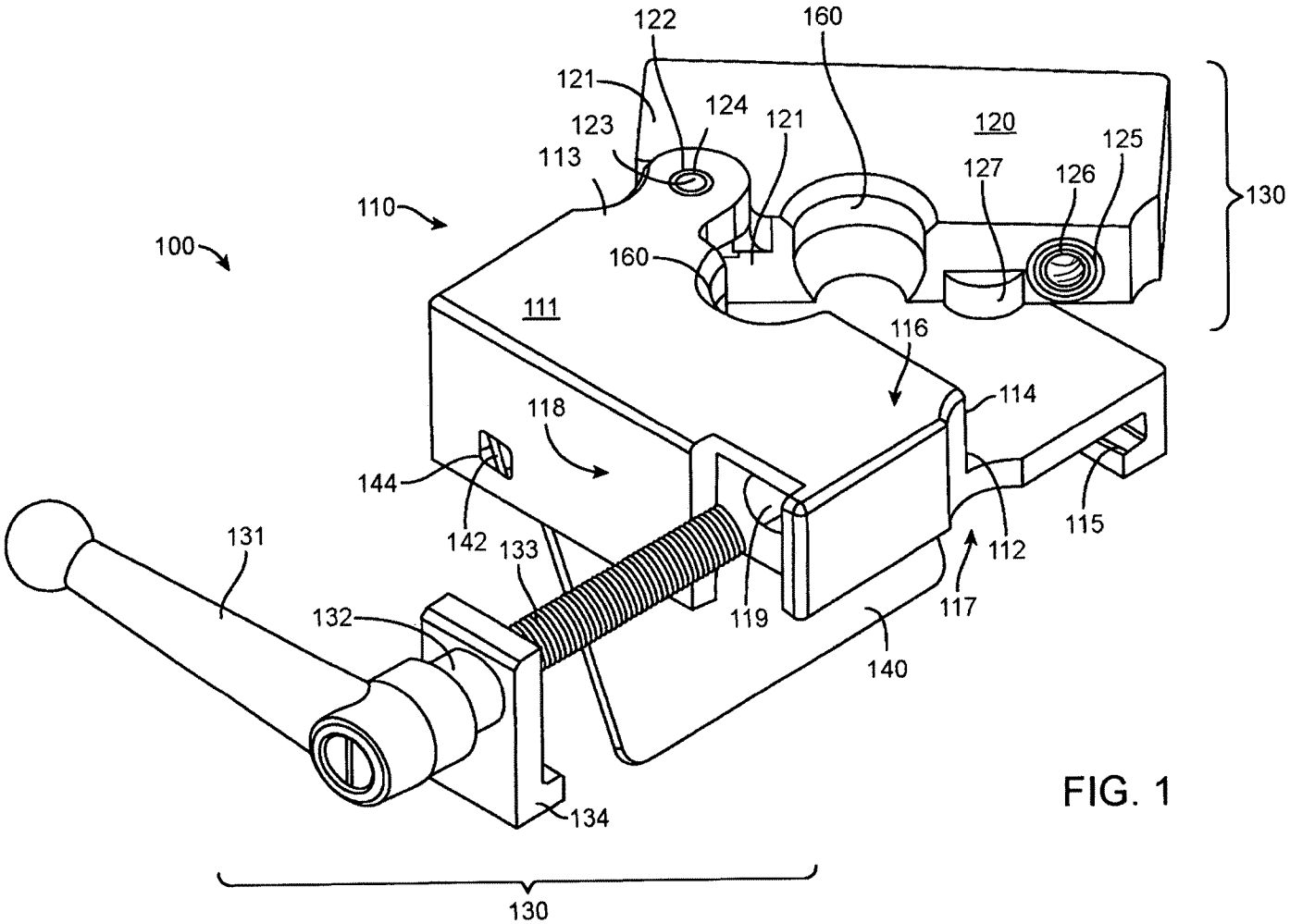
FIG. 1 illustrates schematic top view of the apparatus, system, and method in accordance with an embodiment of the present invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "body" "body part" "extremity" or "limb" refers to a body part or extremity consisting of foot, ankle, knee, leg, hand, wrist, arm and shoulder of a patient.

As used herein the term "Flash" sterilization is defined as steam sterilization of an unwrapped object at 132° C. for 3 minutes at 27-28 lbs. of pressure in a gravity displacement sterilizer 843 as pioneered by the Underwood and Perkins. Currently, the time required for flash sterilization depends on the type of sterilizer and the type of item, i.e., porous vs non-porous items. Although the wrapped method of sterilization is preferred for the reasons listed below, correctly performed flash sterilization is an effective process for the sterilization of critical medical devices. Flash sterilization is a modification of conventional steam sterilization (either gravity, pre-vacuum, or steam-flush pressure-pulse) in which the flashed item is placed in an open tray or is placed in a specially designed, covered, rigid container to allow for rapid penetration of steam.

As used herein the term "holder" or "extremity holder" refers to a device or a means for supporting the body part, or joint thereof, of a patient in the preparation for surgery or medical activity and/or during surgery to hold a body part for access to the body part. A holder can be used to position the body part such as an arm or leg for patient preparation.

As used herein the term "patient" refers to any recipient of health care services. The patient is most often ill or injured and in need of treatment by a surgeon, physician, physician assistant, advanced practice registered nurse, veterinarian, or other health care provider.

As used herein the term "medical activity" refers to the provision of medical care consisting of hospital activities, medical and dental practice activities, and "other human health activities" by a surgeon, physician, physician assistant, advanced practice registered nurse, veterinarian, or other health care provider. "Medical activity" can also include to numerous activities of medical treatment, diagnosis, preparation for surgery, or inspection of a body part so as to hold a body part for access to the body part.

As used herein the terms "surgery", "operation" "surgical procedure" or refers an act of performing surgery such as by a surgeon, or simply to investigate and/or treat a pathological condition such as disease or injury, or to help improve bodily function or appearance using operative manual and instrumental techniques on a patient to in the medical specialty context. The adjective surgical means pertaining to surgery; e.g. surgical instruments or surgical nurse. The patient or subject on which the surgery is performed can be a person or an animal.

Referring to FIGS. 1 through 15A-C, an apparatus, system and method of manufacture of an apparatus for securing an extremity holder to a track on an operating table useful for performing a surgical procedure using the apparatus, generally shown as element 100, in according to an exemplary embodiment of the present invention. Generally, an extremity holder 101 of a pre-determined shape is attached to a post 103 at a proximate end 102 and the post 103 has a distal end 104 with a ball 105 useful for securing the extremity holder 101 to an operating table 106 for performing a predetermined surgical procedure. The operating table 106 can have a track 108 as shown in FIG. 9B, either integral or attached to the operating table 106, for positioning the extremity holder 101 thereby positioning a body part 109 for the surgical procedure 107, as shown in FIG. 9A.

Referring to FIGS. 1 through 15A-C, the apparatus 100 comprises a carriage assembly 110 for supporting the extremity holder 101 on the track 108 and for selective movement of the carriage assembly 110 there along. The carriage assembly 110 has a base 111 defining a rigid rectangular structure with a step 112. The base 111 comprises a base hinge portion 113 located at one end of the step 112 for joining an arm 120 thereto and a recess portion 114 located along said step 112 configured to accept a protrusion 127 on arm 120. The base 111 further comprises a track portion 115 defining rails to attach to the track 108, or to a track 108 operably connected by an extendable track 155 thereof, as shown in FIG. 9A.

The base 111 has surfaces of an upper surface 116, lower surface 117 and side surfaces 118. The upper surface 116 is configured with the step 112 generally located and centered along a mid-line, the hinge portion 113 is located at one end of the step 112, and the recess 114 located at another end of the step 112. The track portion 115 is located on a lower surface 117 of the base 111. The base 111 has side surface(s) 118 so as to define a rigid rectangular structure, which is non-limiting as other designs are possible. Because the base 111 is intended for use in an operating room environment, it is formed from materials that are durable, sturdy, and that can be repeatedly sterilized such as, for example, most commonly formed from stainless steel that is known to reduce bacterial and early bio-film attachment, other suitable metals and metal alloys. The base 111 has a rod opening 119 in a side surface 118 configured to accept a rod 132 of a clamp assembly 130 as is described herein.

The apparatus 100 of the present invention further comprises an arm 120 having an arm hinge portion 121 with an opening 122 formed as a hole configured to operably receive a pin 123 to join the arm 120 to the base 111. The arm 120 is configured to fit to the base 111 adjacent the step 112 whereby the arm hinge portion 121 aligns with the hinge portion 112 on the base so as to be attached with pin 123, thereby opening and closing of the arm 120 by rotation around the pin 123 and arm hinge portion 121 and base hinge portion 113. The base hinge portion 113 and arm hinge portion 121 can include a sleeve bearing 124 to provide smooth rotation around the point formed by the base and arm hinge portions 113, 121 and pin 123. The arm 120 can be a general rectangular shape and formed from a solid material. A suitable material to form the arm 120 is stainless steel yet other materials and/or metal alloys with qualities of durability, strength and that can be repeatedly sterilized to reduce bacterial attachment can be utilized.

Figure 2:
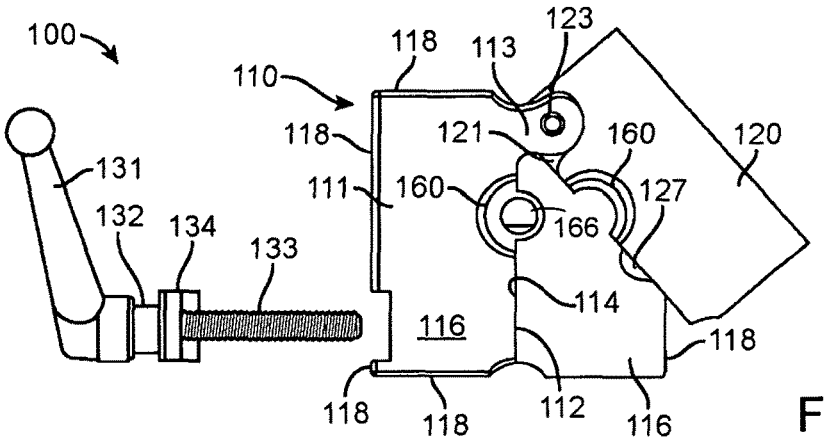
FIG. 2 illustrates the top view the apparatus in accordance with an embodiment of the present invention.
Figure 3:
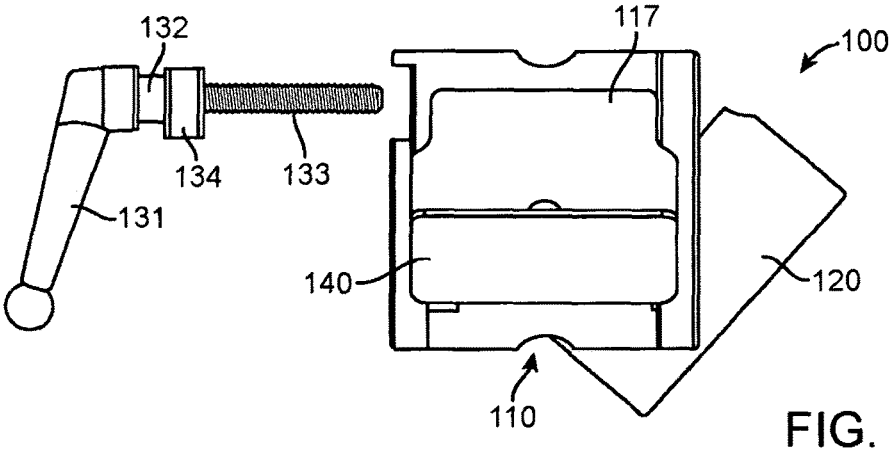
FIG. 3 illustrates the bottom view the apparatus in accordance with an embodiment of the present invention.
Figure 4:
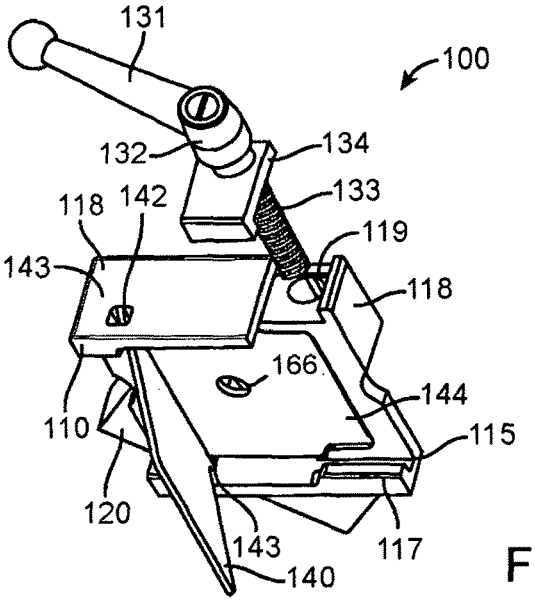
FIG. 4 illustrates schematic bottom view of the apparatus, system, and method in accordance with an embodiment of the present invention.
Figure 5:
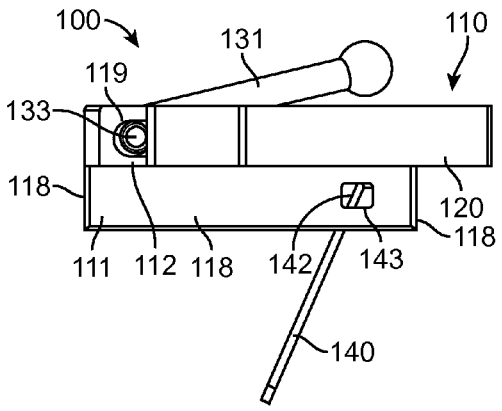
FIG. 5 illustrates a side view the arm and base of the apparatus.
Figure 6:
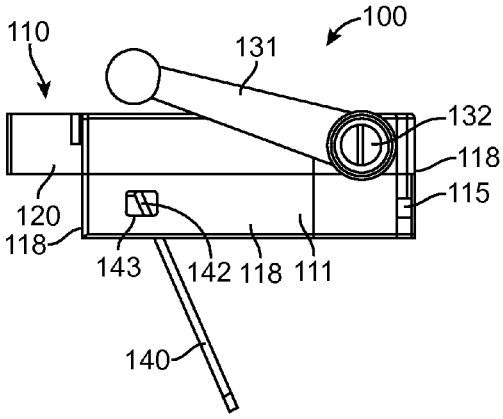
FIG. 6 illustrates a side view the clamp and arm in the base of the apparatus.
Figure 7:
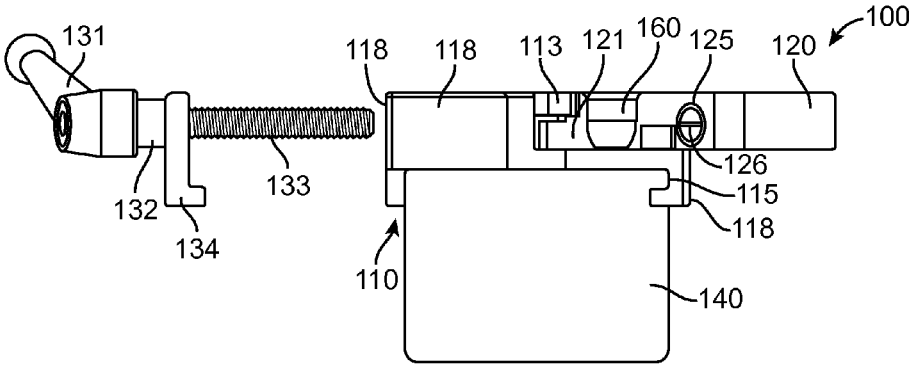
FIG. 7 illustrates a side view of the rotatable opening of the arm and base of the apparatus.
Figure 8:
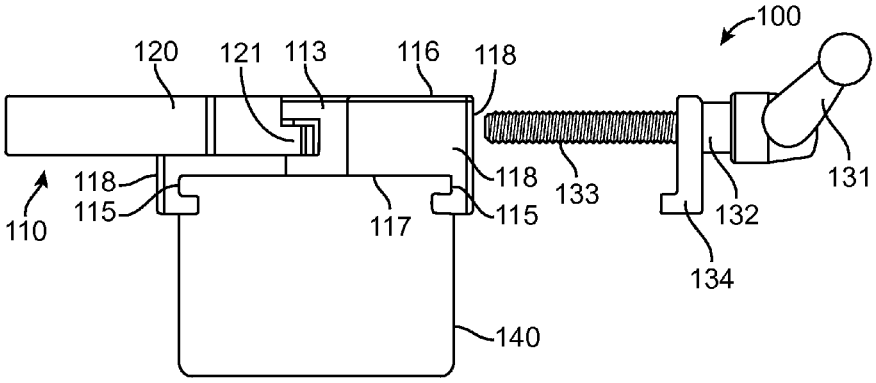
FIG. 8 illustrates a side view of the hinge of the arm and base of the apparatus.
Figure 10:
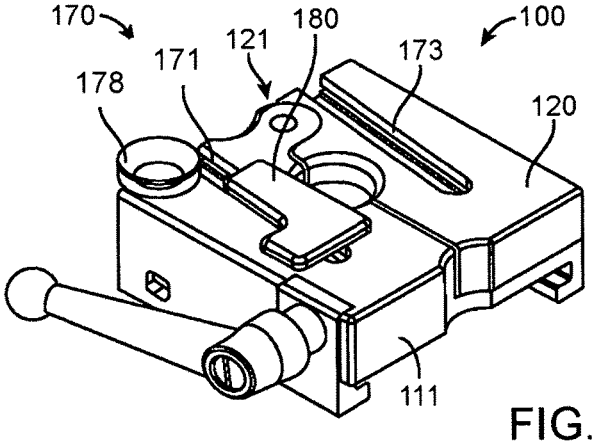
FIG. 10 illustrates a schematic perspective view of the carriage with tilt control according to an embodiment of the present invention.
Figure 11:
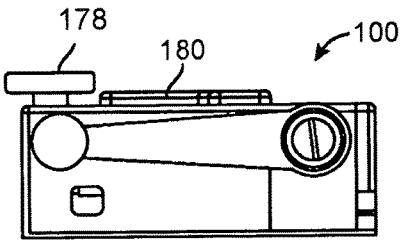
FIG. 11 illustrates a side view of the carriage with tilt control according to an embodiment of the present invention.
Figure 12:
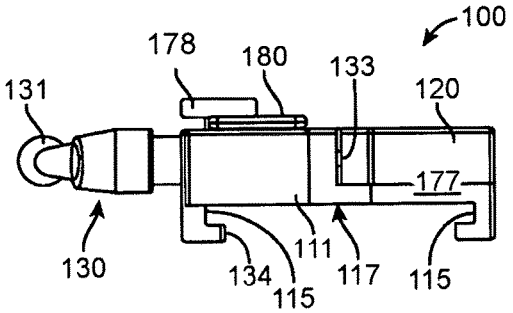
FIG. 12 illustrates a end view of the carriage with tilt control according to an embodiment of the present invention.
Figure 13:
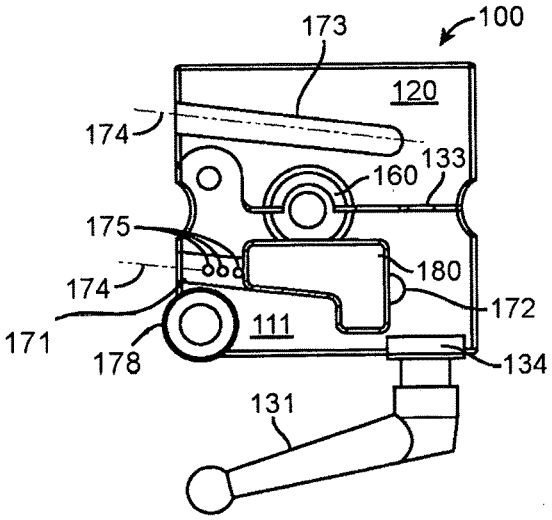
FIG. 13 illustrates a top view of the carriage with tilt control according to an embodiment of the present invention.

As shown in FIG. 1, the arm 120 can be configured with a hole 125 adapted to receive a threaded insert 126 configured to receive the threaded end 133 of the rod 132 to tighten the clamp assembly 130 and perform the holding and securing feature of the present invention. The threaded insert 126 is used to prevent gauging of the solid material of the arm 120 by a threaded end 133 of the rod 132 as may occur with consistent clamping between harder and softer metal and/or metal-alloy materials, for example, the rod may be formed using stainless steel and the body 120 from aluminum. The arm 120 is further configured with a protrusion 127 adapted to fit to the recess 114, as shown in FIG. 2, in base 111 adjacent the step 112 by closing the arm 120. Consequently the ball 105 of an extremity holder 101 can operably connect to the socket 160 connecting angular movement that may be secured by the clamp assembly 130 in a predetermined position with the protrusion 127 operably connected to recess 114.

As shown in FIGS. 1 through 15A-C, the assembly 100 of the present invention is adapted to secure and to hold the extremity holder 101 in a desired position, thereby positioning a body part 109 for a desired surgical procedure 107. The carriage 110 is configured with a socket 160 formed at a mid-point in the upper surface 116 adapted to receive a ball 105 or other attaching means of the extremity holder 101. The socket 160 is formed between the base 111 and arm 120 in the closed position. As the arm 120 abuts the step 112, the protrusion 127 is inserted in the recess along the step 112, thereby creating strength in the holding of the ball 105. The socket 160 can be tightened or loosed to open and close upon the ball 105 by the clamping action of the clamp assembly 130. For example, a tightening operation involves turning the handle 131 in a particular direction which pulls the arm 120 by engaging the threads of the threaded insert 126 in the hole 125 of the arm 120 with the threaded end 133 of rod 132. The base 111 and arm 120 are joined and form a fulcrum at the hinge formed by the pin 123 and arm and base hinge portions 113, 121, thereby tightening the hold around the ball 105 in the socket 160. A loosening operation involves turning the handle 131 in a particular direction opposite tightening direction, thereby releasing the hold around the ball 105 in the socket 160 by the similar action of the threads pushing the arm 120 outwardly by the action of engaging the threads of the threaded end 134 and threaded insert 126.

As shown in FIGS. 1 through 15A-C, a clamp assembly 130 is configured with a handle 131, rod 132 with at least a threaded distal end 133, and a track clamp tab 134. The handle 131 can be made from stainless steel and have an ergonomic design suitable to provide tightening and improved operation in a user's hands. The rod 132 can similarly be made from made from stainless steel. Each of the handle 131 and rod 132 using these material can be sterilized easily using known sterilization techniques. The track clamp tab 134 is used to secure and hold the position of the carriage 110 the track 108 by a compression friction fit in the operation of tightening of the clamp assembly 130. As above, the clamp assembly 130 operates in conjunction with the base 111 and arm 120 as joined at the hinge (the pin 123 and the base and arm hinge portions 113, 121) to form a fulcrum to tighten and loosen the hold around the ball 105 in the socket 160 that may include an opening 166 formed in the base 111 for improved clearance of tissue and/or fluids and/or sterilization.

As shown in FIGS. 1 through 15A-C, a sliding plate 140 is located between a lower surface 117 of the base 111 and the track 108 for improving sliding movement and positioning of said carriage 110 along the track 108. The sliding plate 140 is formed of a predetermined friction reducing material including a polymer and other materials that can be sterilized. The sliding plate 140 has a generally planar surface 141 shape and tab(s) 142 at one edge configured for placement in holes 143 of the base 111. The sliding plate 140 is configured to pivot between a closed position in a recess 144 in the lower surface 117 of the base 111 when interposed between the base 111 and the track 108 for improving sliding movement and positioning of said carriage 110 along the track 108. The sliding plate 140 can open to an open position having the appearance of a flap useful for cleaning and sterilization as well as ease of maintenance and replacement of the sliding plate 140. As illustrated in FIG. 9A, a base plate 150 is configured for securing to an operating table 106 to attach the assembly 100 thereto. A separate base plate 150 has advantages in that it can be sterilized, used repeatedly, and attached to the operating table. The base plate 150 has a generally rectangular planar shape 151 forming an upper surface 152 and a lower surface 153, similar to the base plate 106 without the extension 155 as illustrated in FIGS. 9B and 9C. According to an embodiment of the present invention, the base plate 150 includes a track 154 configured for the track portion 115 to slide over thereby attaching the carriage 110 of the assembly 100 thereon. The base plate 150 can be attached to the operating table 106 by suitable fasteners, for example, locking on or more knobs 157. As above, the track clamp tab 134 is used to secure and hold the position of the carriage 110 the track 105 by a compression friction fit in the operation of tightening of the clamp assembly 130. In an alternative embodiment of the present invention, the base plate 150 can have an extension plate adapted to join together two tracks an extension track 156 and a track 105, thereby the plate base 150 can accommodate larger limbs and body parts 109 that may extend from the operating table 106 for a particular surgical procedure 107.

Figure 14:
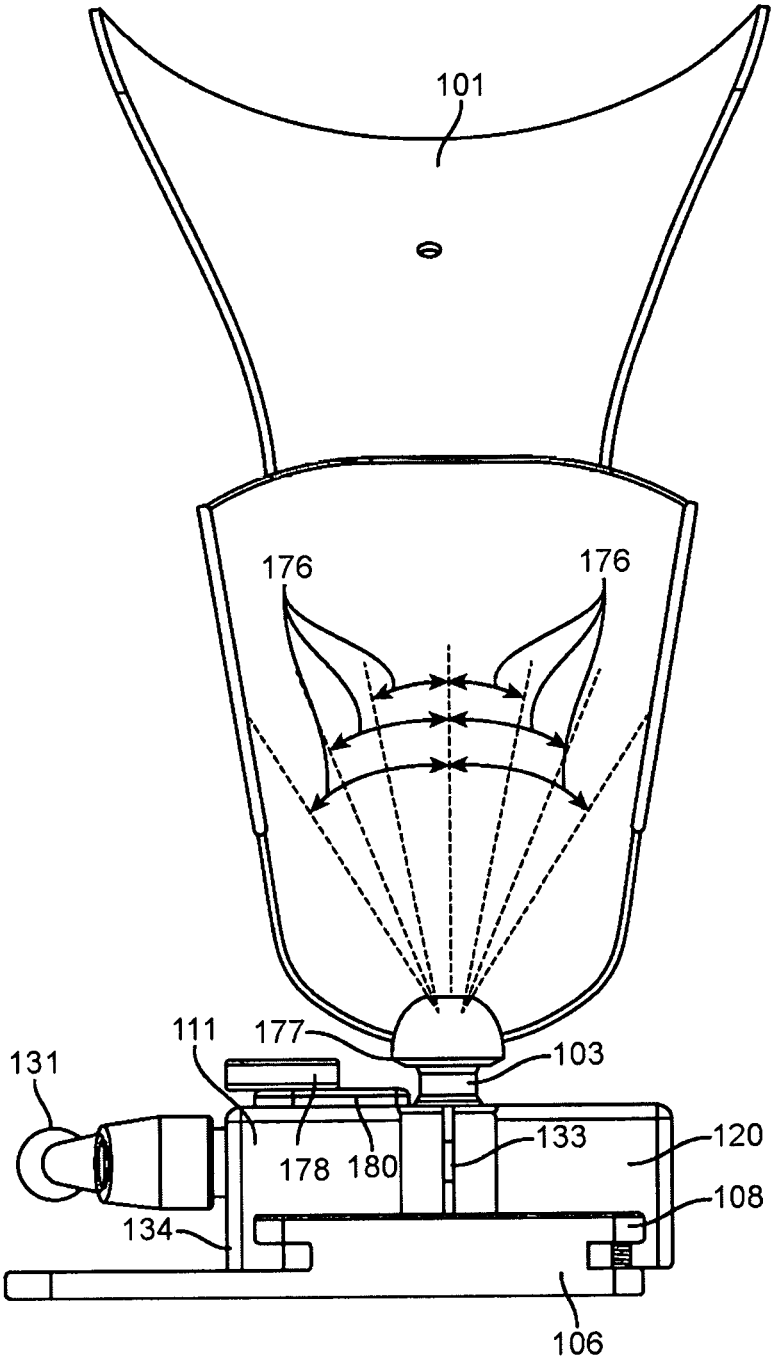
FIG. 14 illustrates a side view of the carriage with tilt control on a track according to an embodiment of the present invention.

Referring now to FIGS. 9B, 10-15A-C, according to another embodiment of the apparatus, system and method 100 of the present invention, carriage assembly 110 incorporates a tilt control assembly 170. The tilt control assembly 170 includes a slide assembly 180 configured to follow pathway 172 located on the base 111. An additional pathway 173 can be located on the arm 120. Pathways 172 and 173 may be formed in a predetermined trajectory 174 as well as formed with dimples 175, which trajectory and dimples 175 can provide a predetermined tilt angle(s) 176 as shown in FIG. 14. For example, the trajectory 173 can be linear or arcuate so as to locate the slide assembly 180 positioned contiguous with the post 103 of the extremity holder 101. Alternatively, increased material or a flange 177 can be located on a distal portion 104 adjacent the ball 105 of the post 103 in order to more fully engage the slide assembly 180.

Figure 15A:
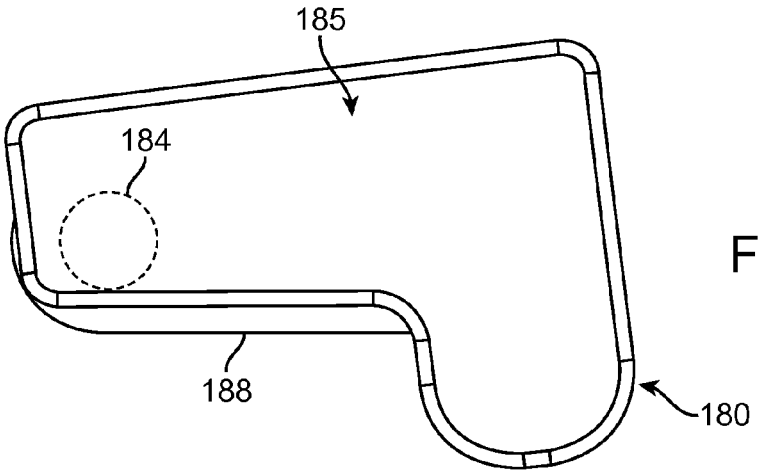
FIGS. 15A, 15B and 15C illustrate a top, exploded side and perspective schematic views of the insert and slide for the tilt control according to an embodiment of the present invention.
Figure 15B:
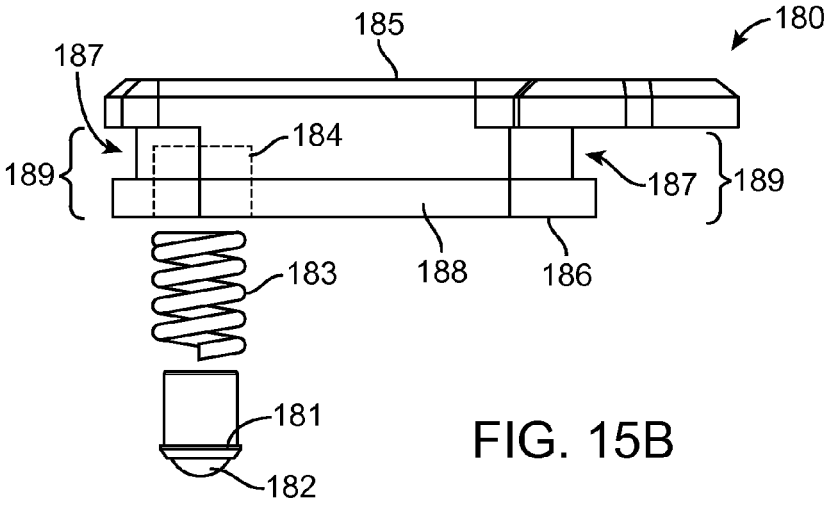
Figure 15C:
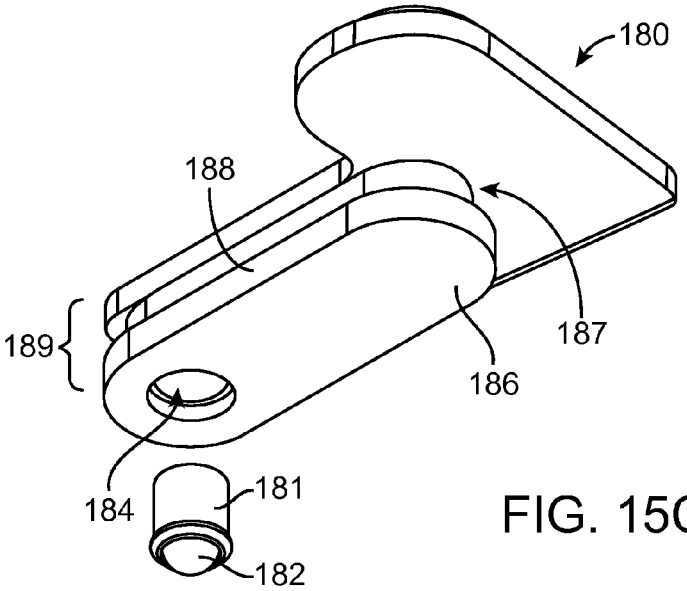

Referring to FIGS. 15A, 15B and 15C, slide assembly 180 can be configured with an insert 181 adapted as a housing to hold a ball bearing 182 and for a spring 183 to fit on the outside of the insert 181 housing as is shown in FIG. 15B. Alternatively, it is appreciated that the spring 183 can be selected to fit inside the insert 181 housing. The insert 181, ball bearing 182 and spring 183 are designed to fit into the recess of hole 184 as shown in FIGS. 15A-15C. The slide assembly 180 has a top surface 185 configured for the hand or finger such as, for example, a thumb to move the slide assembly along pathway 172, 173. The slide assembly 180 also has a bottom surface 186 configured with the hole 184 to receive the insert and spring 181, 183. The slide assembly 180 is configured to slide along pathway(s) 172, 173 with the insert 181 engaging dimple(s) 175. In order to track the pathways, the slide assembly 180 may be formed with an inner recess 187 and a bottom flange 188 so as to form a groove guide 189 for slidably engaging the pathways 172, 173. The inner recess 187, bottom flange 188, and/or groove guide 189 may be formed by milling in a CNC machine.

As shown in FIGS. 9B, 10, 13 and 14, the pathways 172 and 173 can allow the slide assembly 180 to be located on either side so as set a predetermined tilt angle 176, shown in FIG. 14. Although the carriage assembly 100 is adaptable to locate and lock precisely the body part 109 in a predetermined position for a surgical procedure 107 with fine adjustment for the patient, establishing a known tilt angle may be advantageous in a variety of surgical procedures. In certain surgical procedures, one or more slide(s) 180 may be fitted and secured on both sides to pathways 171, 172, whereby the holder 101 is secured in a manner making it not possibly to tilt either way as the post 103 will engage the slide(s) 171 in pathways 171, 172 to stop further movement as is illustrated in FIG. 9B. For example, in a knee operation of a larger limb (i.e. heavier), the weight of the body part 109 may shift the predetermined angle 176. According to an embodiment of the present invention, the slide assembly 180 is moved along pathway 172 (or alternatively 173) under flange 177 on post 103 of the extremity holder 101 until the predetermined angle 176 is established for body part 109. The position can be secured by the clamp assembly 130, whereby the handle 131 is tightened threaded end 133 joining the base 111 and arm 120 around the ball 105 of the extremity holder.

According to another embodiment of the present invention, the slide assembly 180 is moved along pathway 172 engaging one or more dimples 175 established for the predetermined angle 176 (i.e. setting angles of 1°, 2°, 3°, . . . or 2°, 4°, 6°, . . . or 5°, 10°, 15°, . . . etc). In a linear trajectory 174 the dimples 175 are spaced equally. In an arcuate trajectory 174 the dimples 175 may be spaced at varying distances. The slide assembly 180 may include a ball bearing 182 and spring 183 to engage and disengage the dimples 175, as these may be formed in the pathway 171 in base 111 and/or another pathway 173 in arm 120, as the slide assembly 180 is slidably moved.

According to another aspect of the present invention, the parts for the tilt control assembly 170 are minimized consisting essentially of the slide assembly 180 and milled pathways 172 and 173 in the base 111 and arm 120 are easily sterilized so as to lower the cost of use of the present invention. Moreover, the parts the slide assembly 180 and milled grooved guide 189 for pathways 172, 173 as well as the insert 181 (with ball bearing 182 secured therein) and spring 183 are easily sterilized so as to lower the cost of use of the present invention.

According to another aspect of the present invention, a knurled knob 178 may be formed in tilt control assembly 170 to tighten the carriage base 111 to an operating table 106 and prevent movement in all x, y and z directions. The knurled knob 178 is configured to be inserted into a threaded hole in the base 111 so as to set location on the operating table 106 or other track. The knurled knob 178 is configured locks carriage assembly 100 base 111 anywhere on track thereby forming an "e-brake" and stopping any translational force to assist the clamp assembly 130 with additional locking so as not slide along the rail or track. These parts are again minimized for sterilization as the knurled knob 178 requires removal and the hole and knob 178 can be easily cleaned and sterilized.

While certain configurations of structures have been illustrated for the purposes of presenting the basic structures of the present invention, one of ordinary skill in the art will appreciate that other variations are possible which would still fall within the scope of the appended claims. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for securing an extremity holder to a track on an operating table for performing a surgical procedure comprising:

a carriage supported on the track for selective movement there along, said carriage comprising:

a base configured with a track portion formed on a lower surface adapted to engage the track and for sliding movement there along, said base having a base hinge portion formed on an upper surface thereof at a predetermined location, said base hinge portion configured with an opening located at said predetermined location with said opening extending through said upper surface and lower surface;

an arm configured to fit to said base adjacent said hinge portion, said arm configured with an arm hinge portion having a second opening, said arm being attached to said base by a pin passing through said opening in said base hinge portion and said second opening in said arm hinge portion so as to move said arm relative to said base;

said base configured with a rod opening located on a side thereof, said rod opening extends through said base and aligns with a threaded portion on said arm;

a socket formed by said base and said arm configured to accept a ball of said extremity holder in said socket, said socket generally adapted to operably connect the extremity holder in said carriage in a desired position upon which the surgical procedure is to be performed, a clamp for releasably locking said ball of the extremity holder in said socket and releasably locking said track portion of said carriage on the track, said clamp comprising a handle and a rod with a threaded end, whereby said rod is configured to extend through said rod opening formed in said base and to operably connect said threaded end in said arm, said handle configured to form a clamping arrangement between said track portion and the track by engaging said threaded end to said threaded portion and/or for securing said ball in said socket.

2. The apparatus of claim 1 further including a sliding plate, said sliding plate being formed of a generally planar surface, said sliding plate configured with one or more tabs adapted to engage in a tab opening formed in each side surface and adjacent said lower surface of said base to provide pivoting of said sliding plate therein, said sliding plate further configured to pivot in a recess formed in said lower surface of said base for improving sliding movement and positioning of said carriage along said track portion of said base.

3. The apparatus of claim 2 wherein said sliding plate is formed of friction reducing material including a polymer.

4. The apparatus of claim 1 including a base plate for the operating table, said base plate comprised of a unitary construction having an upper surface and lower surface; said lower surface adapted to secure to the operating table, said upper surface having the track extending therefrom for operably connecting to said track portion of said carriage.

5. The apparatus of claim 1 whereby said clamp forms said clamping arrangement between said track portion and the track by engaging threaded end in said threaded portion for said desired position of said carriage and by disengaging said clamping arrangement by said threaded portion enabling sliding movement of said carriage along said track portion.

6. The apparatus of claim 1 whereby the extremity holder is adapted to engage and support a body part and/or a human joint of a patient which the surgical procedure is to be performed, whereby said clamp allows said holder to be releasably positioned and locked along the track portion in a desired position for the surgical procedure.

7. The apparatus of claim 1 wherein said base of the carriage is formed from a solid material such as metal, aluminum, stainless steel, and/or metal alloys.

8. The apparatus of claim 1 wherein said arm is formed from a solid material such as metal, aluminum, stainless steel, and/or metal alloys.

9. The apparatus of claim 1 wherein said base hinge portion further comprises a sleeve bearing secured in said base opening and adapted to receive said pin therein, said sleeve bearing configured to provide rotation of said arm secured to said base at said predetermined location.

10. The apparatus of claim 1 wherein said arm includes a threaded insert disposed adjacent said rod opening and adapted to receive said threaded end, said threaded insert configured to prevent gauging of said solid material of said arm by said threaded end of said rod upon clamping.

11. The apparatus of claim 1 wherein said arm includes a protrusion and said base includes a recess located adjacent said socket, whereby said protrusion is configured to align with said recess and to cooperate with said socket for improved holding of the extremity holder and locking the extremity holder upon clamping.

* * * * *